US006955348B2

(12) United States Patent
Koga

(10) Patent No.: US 6,955,348 B2
(45) Date of Patent: Oct. 18, 2005

(54) SHEET FEEDER WHICH SEPARATES SHEETS WITH VARIABLE SPEED AND/OR DIRECTION BLOWN AIR AND IMAGE FORMING APPARATUS USING SAME

(75) Inventor: Hiroto Koga, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 10/650,774

(22) Filed: Aug. 29, 2003

(65) Prior Publication Data

US 2004/0089994 A1 May 13, 2004

(51) Int. Cl.[7] ..... B65H 3/14
(52) U.S. Cl. ..... 271/97; 271/98
(58) Field of Search ..... 271/97, 98

(56) References Cited

U.S. PATENT DOCUMENTS

| | | | | |
|---|---|---|---|---|
| 2,402,442 A | * | 6/1946 | Perry | 271/98 |
| 4,596,385 A | * | 6/1986 | Silverberg | 271/94 |
| 5,110,110 A | * | 5/1992 | Wirz et al. | 271/98 |
| 5,328,165 A | * | 7/1994 | Martin | 271/98 |
| 6,298,214 B1 | | 10/2001 | Koga | 399/322 |
| 6,726,200 B2 | * | 4/2004 | Gohl et al. | 271/97 |
| 2004/0100013 A1 | * | 5/2004 | Mathewson | 271/98 |

FOREIGN PATENT DOCUMENTS

| | | | |
|---|---|---|---|
| JP | 62-249835 | | 10/1987 |
| JP | 6199437 | * | 7/1994 |

OTHER PUBLICATIONS

Max Born, et al., Principles of Optics: Electromagnetic Theory of Propagation Interference and Diffraction of Light, Sixth Edition (1980), Cambridge University Press, pp. 169–170, 213.

* cited by examiner

*Primary Examiner*—David H. Bollinger
(74) *Attorney, Agent, or Firm*—Fitzpatrick, Cella, Harper & Scinto

(57) ABSTRACT

A sheet feeder has a plurality of sheets supported on an intermediate plate, and feeds sheets separately one by one by attracting them by a suction belt. Air is blown from a blowing duct through an opening toward a side edge of a sheet bundle supported by the intermediate plate in order to handle the sheet bundle, and so as to vary the speed and/or direction of air blown from the opening to reliably handle the sheet bundle, whereby a sheet conveying operation by the suction belt is performed when the speed of air blown on the side edge of the sheet located in the uppermost position bundle is not more than a predetermine value.

22 Claims, 8 Drawing Sheets

SHEET FEEDER WHICH SEPARATES SHEETS WITH VARIABLE SPEED AND/OR DIRECTION BLOWN AIR AND IMAGE FORMING APPARATUS USING SAME

BACKGROUND OF THE INVENTION

1. Field of the Invention

The present invention relates to a sheet feeder that feeds sheets one by one from a sheet bundle stacked in a sheet storage section.

2. Description of the Related Art

To date, in image forming apparatuses such as copying machines and printers, cut sheets serving as recording media that can be continuously fed have usually been limited to high quality paper or to ordinary paper designated by copying machine makers. Because such paper is low in surface smoothness and air-permeability, air easily enters between sheets, so that, when paper is taken out from stacked paper one by one, a double-feed due to paper-to-paper adhesion rarely occurs.

In recent years, however, with the diversification of recording media, there has been growing requests to form an image on cardboard, OHP paper, and tracing paper, and in addition, on art paper, coated paper, and the like, each of which has a smooth surface and each of which has been subjected to a coating treatment on the sheet surface thereof in order to produce gloss and to increase the degree of whiteness based on the market demand for colorization. However, OHP paper, tracing paper, art paper, coated paper, and the like each have high smoothness and air-permeability, and therefore, especially when sheets are stacked in a high moisture environment, double-feed and/or misfeed frequently occurs due to sheet-to-sheet adhesion when using the friction separation method, which has been generally used for conventional copying machines, printers, and the like.

On the other hand, the air sheet feeding method in which sheets are handled by blowing air from a side edge of a paper bundle, and in which the sheets are fed one by one from the sheet located in the uppermost position by a suction unit and a conveying belt that are each disposed above the sheet bundle, has been adopted in printing industry, or used for some copiers. Over the friction separation method, this air sheet feeding method has advantages as follows: 1) a wide setting latitude of paper feed conditions for materials, 2) adaptability for high-speed feeding, 3) high durability, and 4) lower running cost.

Such proposals related to the air sheet feeding have been made in large numbers. For example, Japanese Patent Laid-Open No. 62-249835 discloses a method in which air is blown by an air blowing unit from the direction parallel with the top surface of a sheet toward the front end side of sheets stacked on a paper feed stand, and that the pressure within a suction cylinder opened above sheets is made negative by a negative pressure generating unit to create suction pulling the sheet upward. In this paper feeding device, the sheet located in the uppermost position of the sheets stacked on the paper feed stand is lifted up by a suction action from the opening, and air is blown into a space formed between the sheet located in the uppermost position and that located in the second position by the air blowing unit, in order to reliably perform the separation between the two sheets.

However, as described above, since OHP paper, tracing paper, art paper, coated paper, and the like each have high smoothness and air-permeability, sheet-to-sheet adhesion is high especially when sheets are stacked in a high moisture environment. Here, when the air sheet feeding method is adopted, the uppermost portion of a sheet bundle is lifted off in the state of a bundle at an interface having a relatively weak adhesive force because air blown from the side edge of the sheet bundle is a steady flow. As a result, it has been impossible to inject air into a space between sheets of the lifted sheet bundle, thereby making it very difficult to reliably separate sheets one by one.

SUMMARY OF THE INVENTION

Accordingly, it is an object of the present invention to provide a sheet feeder that, in an air sheet feeding method having advantages such as material-adaptability, high-speed paper feeding, high durability, and so on, reliably eliminates sheet-to-sheet adhesion to thereby reduce the occurrence of a misfeed or double-feed by a simple arrangement, and to realize the downsizing of the apparatus, the reduction of the product cost and operational cost, and the improvement in reliability.

In one aspect of the present invention, there is provided a sheet feeder including a sheet stacking unit to support a sheet bundle; sheet suction conveying unit for generating air suction and conveying one by one a sheet of the sheet bundle supported by the sheet stacking unit, the conveyance being of an uppermost sheet of the sheet bundle; air blowing unit for blowing air against a side edge of a sheet bundle supported by the sheet stacking unit; and air speed adjusting unit for varying a speed of the air blown from the air blowing unit. In this sheet feeder, when the speed of the air blown by the air blowing unit by the air speed adjusting unit is not more than a predetermined value, a sheet conveying operation of the sheet suction conveying unit is performed.

In another aspect of the present invention, there is provided a sheet feeder including a sheet stacking unit to support a sheet bundle; sheet suction conveying unit for generating air suction and conveying one by one a sheet of the sheet bundle supported by the sheet stacking unit, the conveyance being of an uppermost sheet of the sheet bundle; air blowing unit for blowing air against a side edge of the sheet bundle supported by the sheet stacking unit; and air direction adjusting unit for varying a direction of the air blown by the air blowing unit. In this sheet feeder, when a speed of the air blown by the air direction adjusting unit is not more than a predetermined value, a sheet conveying operation of the sheet suction conveying unit is performed.

In still another aspect of the present invention, there is provided a sheet feeder including a sheet stacking unit that supports a sheet bundle; sheet suction conveying unit for generating air suction and conveying one by one a sheet of the sheet bundle supported by the sheet stacking unit, the conveyance being of an uppermost sheet of the sheet bundle; air blowing unit for blowing air against a side edge of a sheet bundle supported by the sheet stacking unit; air speed adjusting unit for varying a speed of air blown by the air blowing unit; and air direction adjusting unit for varying a direction of air blown by the air blowing unit. In this sheet feeder, when the speed of the air blown by the air blowing unit by cooperative action of the air speed adjusting unit and the air direction adjusting unit is not more than a predetermined value, a sheet conveying operation of the sheet suction conveying unit is performed.

In a further aspect of the present invention, there is provided a sheet feeder including an intermediate plate for holding a sheet bundle; a suction duct located above the intermediate plate; a suction belt provided so as to surround the suction duct located above the intermediate plate; a blowing duct located on a side of the intermediate plate and blowing air toward the sheet bundle on the intermediate plate; and a shutter disposed between the sheet bundle on the intermediate plate and the blowing duct, the shutter having a slit, and the shutter being moveable in a substantially vertical direction between a lowermost position and an uppermost position. In this sheet feeder, the suction belt is rotatable and when rotated delivers an uppermost sheet of the sheet bundle when the shutter has substantially reached the uppermost position.

Further objects, features and advantages of the present invention will become apparent from the following description of the preferred embodiments with reference to the attached drawings.

DESCRIPTION OF THE PREFERRED EMBODIMENTS

Hereinafter, a first embodiment according to the present invention will be described with reference to the accompanying drawings.

Overall Construction

Figure 1:
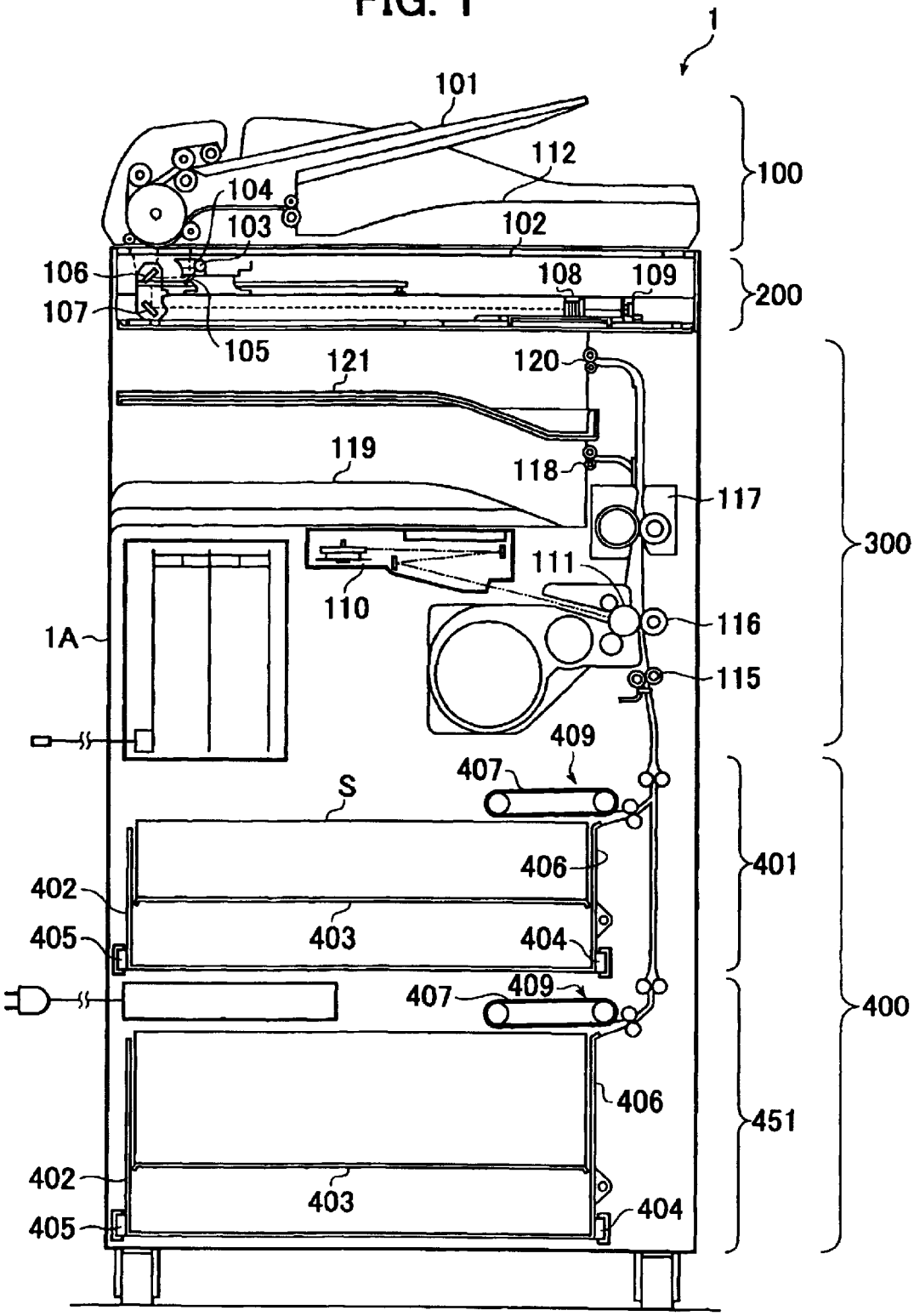
FIG. 1 is a sectional view illustrating a copying machine according to a first embodiment of the present invention.

FIG. 1 is a sectional view showing the main section of a copying machine 1 as an example of an image forming apparatus according to the present invention.

Referring to FIG. 1, the copying machine 1 includes an image reader 200 for reading an image of an original document, a printer 300 for forming an image on a sheet, and a paper feed section 400 for feeding sheet to the printer 300. The paper feed section 400 has a paper decks 401 and 451 that share a paper feeding mechanism. The paper deck 401 holds a maximum of 1000 sheets, while the paper decks 451 holds a maximum of 1500 sheets. The paper feed section 400 will be detailed later.

The image reader 200 is equipped with an automatic original-document feeding device 100 for automatically feeding an original document to the image reader 200. The automatic original-document feeding device 100 feeds original documents set face up on an original document tray 101 one by one in sequence from the top page in the left direction in FIG. 1. Then, via a curved path, the automatic original-document feeding device 100 conveys the document, on a platen glass 102, from the left through an original document flow reading position to the right, and thereafter, discharges the original document to a paper discharge tray 112.

When the original document passes through the flow reading position on the platen glass 102 from the left to the right, the original document is read by a scanner unit 104 held at a position corresponding to the flow reading position. In general, this reading method is referred to as an "original document flow reading method". Specifically, when the original document passes through the flow reading position, the reading surface of the original document is irradiated by light of the lamp 103 of the scanner unit 104, and reflected light from the original document is introduced to a lens 108 through mirrors 105, 106, and 107. Light that has past through the lens 108 forms an image on the image pickup surface of an image sensor 109.

In this manner, by conveying the original document so as to pass through the flow reading position from left to right, an original document reading scan is performed in which the direction perpendicular to the conveying direction of the original document is referred to as the main scanning direction, and in which the conveying direction of the original document is referred to as the sub-scanning direction. That is, when the original document passes through the flow reading position, the entire images of the original document are read by conveying the original document in the direction of the sub-scanning direction while reading the original document images with the image sensor 109 by one line in the main scanning direction. The images optically read are converted into image data by the image sensor 109 and outputted. The image data outputted from the image sensor 109 is subjected to predetermined processing in an image signal control section (not shown), and then inputted as video signals to an exposure control section 110 of the printer 300.

It is also possible to convey the original document on the platen glass by the automatic original-document feeding device 100, then stop it in a predetermined position, and in this state, read the original document by causing the scanner unit 104 to scan from left to right. This reading method is referred to as an "original document fixed reading method".

When reading the original document without using the automatic original-document feeding device 100, firstly the automatic original-document feeding device 100 is lifted up, and after the original document is placed on the platen glass 102, it is read by causing the scanner unit 104 to scan from the left to the right. That is, when reading the original document without using the automatic original-document feeding device 100, original document fixed reading is performed.

The exposure control section 110 of the printer 300 modulates laser light and outputs the modulated laser light based on an inputted video signal, and the laser light is irradiated on a photosensitive drum 111 while being scanned by a polygon mirror. An electrostatic latent image is formed on the photosensitive drum 111 in response to the scanned laser light. Here, as described later, when original document fixed reading is performed, the exposure control section 110 outputs laser light so that a correct image (image that is not a mirror image) is formed.

The electrostatic latent image on the photosensitive drum 111 is visualized as a developed image by a developer supplied by a developing device (not shown). A resist roller 115 conveys the sheet fed by the paper decks 401 and 451, between the photosensitive drum 111 and a transfer section 116 with the timing in synchronization with the start of the irradiation of laser light. The developer image formed on the photosensitive drum 111 is transferred onto the sheet fed by the transfer section 116.

The sheet on which the developer image has been transferred is conveyed to a fixing section 117, which fixes the developer image on the sheet by hot-pressing the sheet. The sheet that has passed through the fixing section 117 is discharged to a first discharge tray 119 through a first discharge roller 118, or discharged to a second discharge tray 121 through a second discharge roller 120, by switching a flapper (not shown).

Next, air sheet feeding type paper decks according to the present invention will be described in detail. Here, the paper deck 401 and the paper deck 451 are only different in the maximum storage number of sheets, and hence, the same reference numbers are used to denote the same or equivalent components, and descriptions are made based on the paper deck 401.

Figure 2:
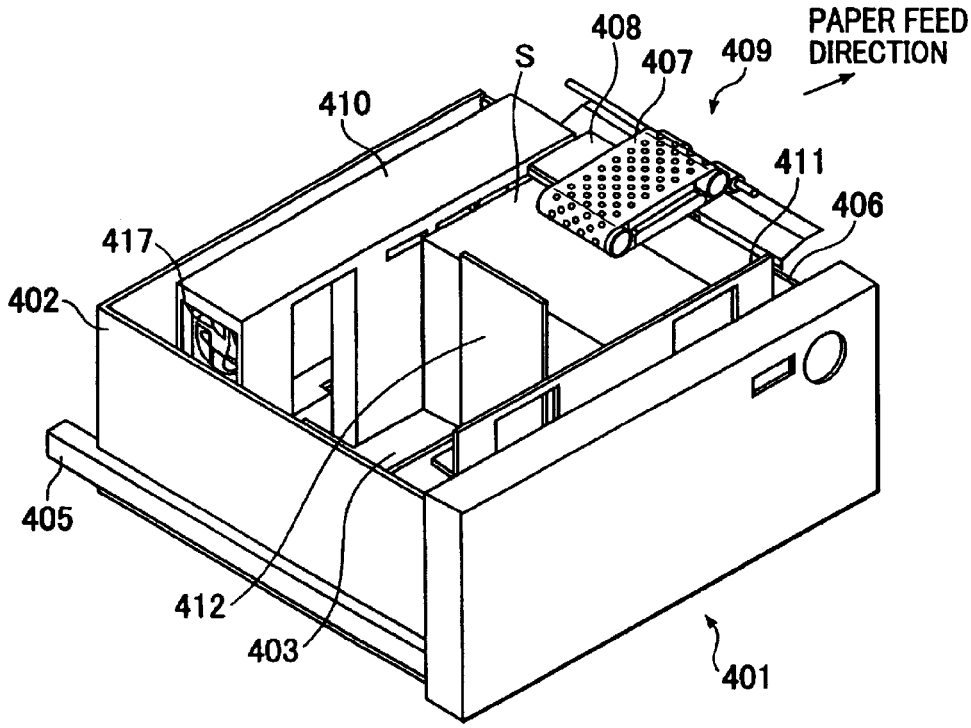
FIG. 2 is a perspective view illustrating a paper deck according to the first embodiment.

FIG. 2 is a perspective view of the air sheet feeding type paper deck 401 according to this embodiment. The paper deck 401 is arranged to stack and store a sheet bundle S on an intermediate plate 403 that is sheet stacking means provided in a repository 402 so as to be moveable up and down. At the respective lower edges on the opposite sides of the repository 402, there are provided rails 404 and 405 (the rail 404 is illustrated in FIG. 1), which can be drawn to the front side with respect to the apparatus body 1A, that is, to the operation side of the copying machine, or in the direction perpendicular to the plane of the FIG. 1. As to the sheet bundle S stacked and stored in the repository 402, the front end and the rear end thereof, respectively, are fixedly placed on predetermined positions by a pre-separation plate 406 and a rear end regulating plate 412, and the respective opposite side ends thereof are fixedly placed on predetermined positions by side regulating plates 410 and 411.

At a position above the stacked sheet bundle S in the sheet feeding direction, there is provided a sheet feed section 409 serving as sheet suction conveying means for lifting by suction, the sheet located in the uppermost position and delivering it. The sheet feed section 409 has a suction duct 408 connected to a suction generating unit (not shown) for generating a suction static pressure above the sheet bundle. A suction belt 407 having large numbers of holes is provided so as to surround the suction duct 408, and in a manner such as to be capable of paper feed rotation in the paper feeding direction.

The sheet feed section 409 feeds a sheet by causing the sheet to adhere to the suction belt 407 by the suction duct 408 and rotating the suction belt 407.

Next, descriptions will be made, with reference to FIG. 3, of the construction and operation of air blowing means provided in the side regulating plate 410 for blowing air on the side edge of the sheet bundle S.

FIGS. 3A to 3D are sectional views when FIG. 2 is seen from the paper feeding direction. Here, the side regulating plate 410 has therein a structure which may serve as the air blowing means. The air blowing means includes a blowing fan 417 (see FIG. 2) serving as the supply source of blown air, and a blowing duct 413 having, at one end thereof, an opening 414 that is opened facing the side of the sheet bundle S stacked and stored in the repository 402. Thereby, blown air is blown from the opening 414 toward the side of the sheet bundle S to handle sheets.

There is provided a shutter 415 that may serve as air speed adjusting means moveable by a drive source (e.g., a motor or solenoid; not shown) substantially in the vertical direction between the side edge and the opening 414. The shutter 415 has, in one portion thereof, a slit 416 having a width sufficiently smaller than that of the opening 414. When located in the lowermost position, the shutter 415 does not block air blown from the opening 414, while, when located in the uppermost position, the shutter 415 completely blocks air blown from the opening 414. Also, when the shutter 415 is located in an intermediate position between the lowermost position and the uppermost position, air blown from the opening 414 passes through the slit 416 of the shutter 415, and is blown against the side edge of the sheet bundle S. There is provided detecting means Sa capable of detecting the position of the shutter 415 when it is located in the uppermost position.

The operations are now described in detail. When the sheet bundle to be fed to the paper deck 401 is set and inserted into the apparatus body 1A, the intermediate plate 403 is lift up to a predetermined height by sheet height detecting means (not shown) using a lift-up motor (not shown). Here, pressing a copy button starts a paper feeding operation.

First, the suction generating unit located at an upper position starts a suction operation, and the suction duct 408 starts a suction action. Consequently, the blowing fan 417 comes into action to blow air on the side edge of the sheet bundle S. Here, the shutter 414 is driven by a drive source (not shown) so as to reciprocate in the up-and-down direction between the side edge of the sheet bundle S and the opening 414 of the blowing duct 413.

Figure 3A:
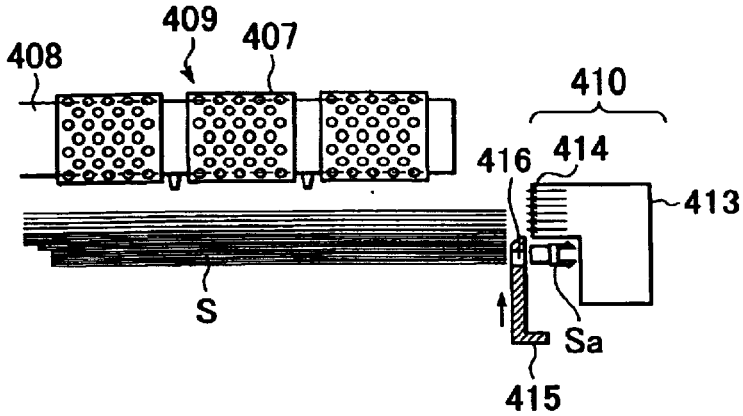
FIGS. 3A to 3D are constructional views illustrating the first embodiment.

Initially, the shutter 415 is located in the lowermost position and is in a state where air blown from the entire opening 414 is blown against the side edge of the sheet bundle S (see FIG. 3A). Next, the shutter 415 is moved upward, and the slit 416 moves up together therewith. When the slit 416 faces the opening 414, the difference between them in a widthwise direction increases the speed of air passing through the slit 416. The air increased in speed by passing through the slit 416 is blown against the side edge of the sheet bundle S while continuously moving upward, and therefore, a handling effect superior to that of conventional steady air flow is produced (see FIGS. 3B and 3C).

Figure 3B:
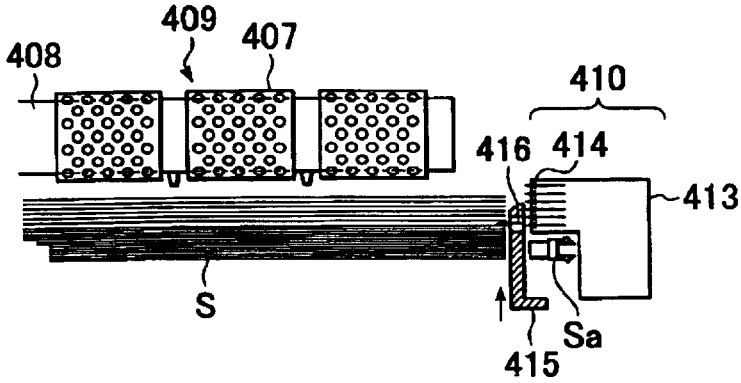
Figure 3C:
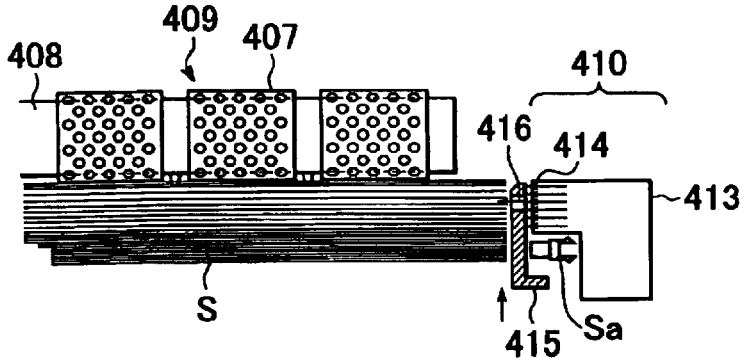
Figure 3D:
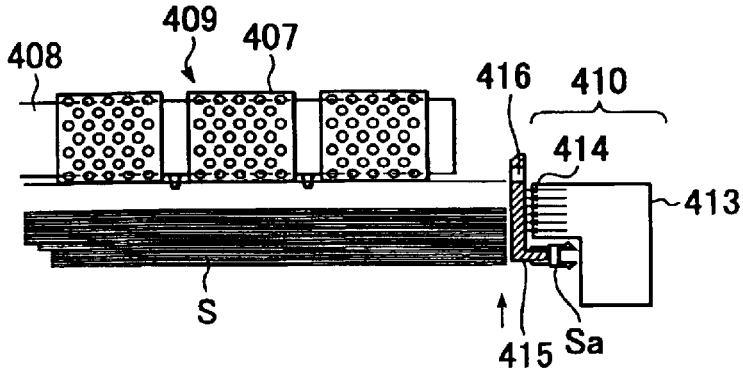

Furthermore, when the shutter 415 reaches the uppermost position, the opening 414 of the blowing duct 413 is completely blocked, so that the entire bundle S that has been lifted off by the blown air falls, and only the sheet located in the uppermost position is attracted to the suction belt 407 under suction by the suction duct 408 (see FIG. 3D). By drive-rotating the suction belt 407 in this point of time, the sheet located in the uppermost position is delivered. Repeating this operation allows sheets to be separately fed reliably one by one with smoothness.

When attempting to feed sheets susceptible to adhesion, such as art paper or coated paper, up-and-down movements of the shutter 415 may be performed several times as preparatory operation of feeding. For example, as described above, when, due to sheet-to-sheet adhesion, sheets cannot be separated by a one-way handling operation from the lowermost position to the uppermost position (FIG. 3A→FIG. 3D), it is possible to reliably inject air between the adhering sheets of the bundle, and eliminate sheet-to-sheet adhesion by causing the shutter 415 to further reciprocate a plurality of times (i.e., by repeating a plurality of cycles: FIG. 3D→FIG. 3A→FIG. 3D). Then, by blocking blown air when feeding the sheet bundle handled at the position shown in FIG. 3D, it is possible to convey only the paper located in the uppermost position attracted to the suction belt 407, and reliably prevent a double-feed due to dragging the subsequent paper.

In the above descriptions, the initial position of the shutter 415 was assumed to be the lowermost position. However, the initial position is not limited to the lowermost position, but it may be an arbitrary position. Also, as the air supply source for the sucking means and air blowing means, a fan such as a sirocco fan, or alternatively, a compressor can be used.

Figure 4:
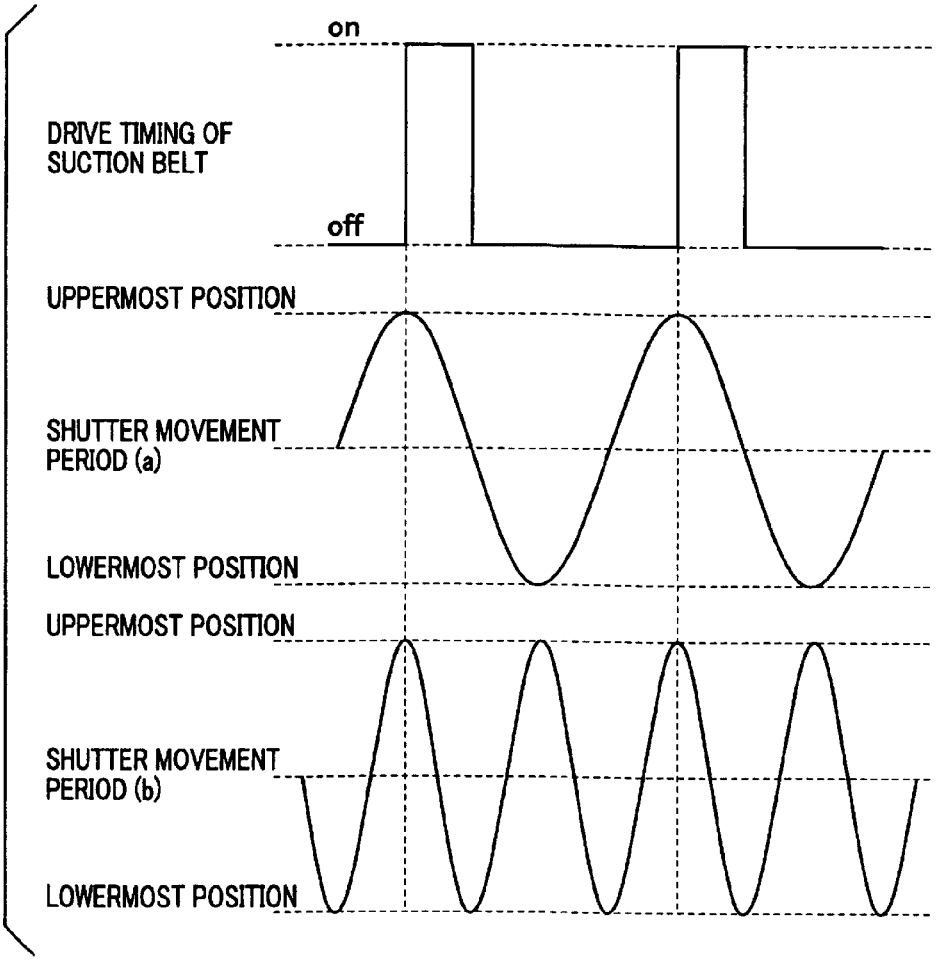
FIG. 4 is a diagram illustrating the timing in the device according to the first embodiment.

FIG. 4 shows the relationship between the drive timing of the suction belt 407 and the movement period of the shutter 415. Driving the suction belt 407 when the shutter 415 is located in the uppermost position would allow a favorable separation delivery operation to be performed. Therefore, clearly, it is possible to provide an excellent sheet feeding device without reducing its productivity, by setting the movement period of the shutter 415 to be n times (n=1, 2, 3 . . . (integral)) the drive timing of the suction belt 407. For example, when the copy rate of the apparatus body is 50 cpm (copies per minute), the movement speed of the shutter is 50 rpm (revolutions per minute) for the movement period (a) of the shutter shown in FIG. 4, and 100 rpm for the movement period (b) thereof. This movement speed of the shutter may be set to an optimum value in accordance with a given parameter such as the type of material. For example, in the case of sheets susceptible to sheet-to-sheet adhesion, reliable separation can be secured by enlarging the movement period of the shutter 415.

When the slit 416 as shown in FIGS. 3B and 3C is opposed to the opening 414, air passing through the slit 416 exhibits the maximum air speed. According to experimental results, the optimum value for the maximum air speed is about 20 m/s, although there are some variations among different kinds of sheets. In the above-described embodiment, as shown in FIG. 3D, when the shutter 415 has completely blocked the opening 414, the suction belt 407 is rotated to separate and deliver sheets. However, if the opening 414 is partially blocked, not completely, but to the extent that sheets are not lifted off, the suction belt 407 may be rotated, with air blown toward the sheet bundle, to separate and deliver the sheets. According to experimental results, in the case of ordinary paper, if the air speed is no more than about thirty percent of the maximum air speed (i.e., not more than about 6 m/s), there is no problem with the separation delivery thereof. On the other hand, in the case of cardboards or coated paper, if the air speed is not more than forty percent of the maximum air speed (i.e., not more than 8 m/s), the separation delivery thereof is practicable without problem.

Second Embodiment

Figure 5A:
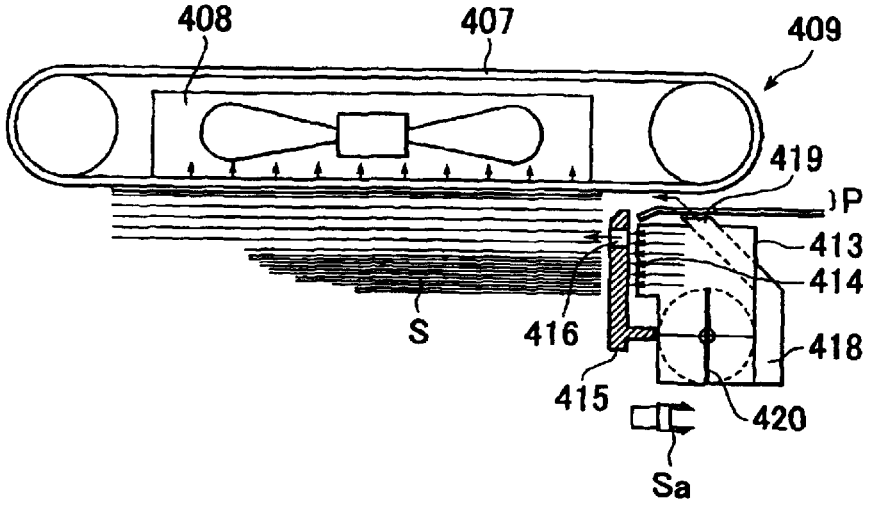
FIGS. 5A and 5B are constructional views illustrating a second embodiment according to the present invention.
Figure 5B:
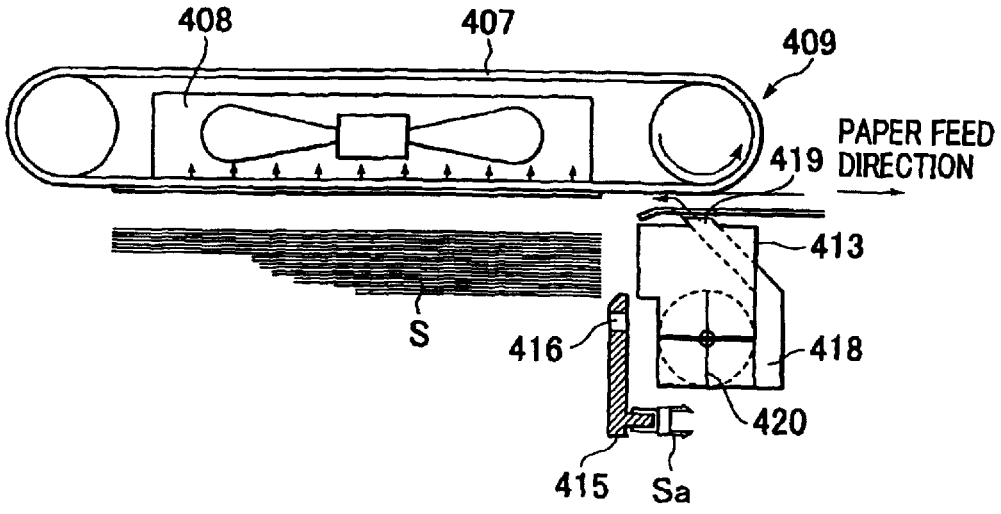
Figure 6A:
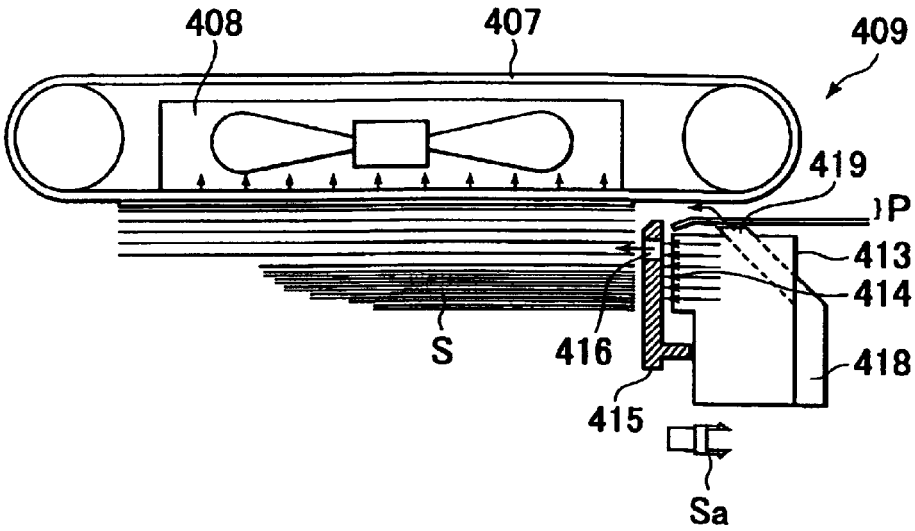
FIGS. 6A and 6B are constructional views illustrating a third embodiment according to the present invention.
Figure 6B:
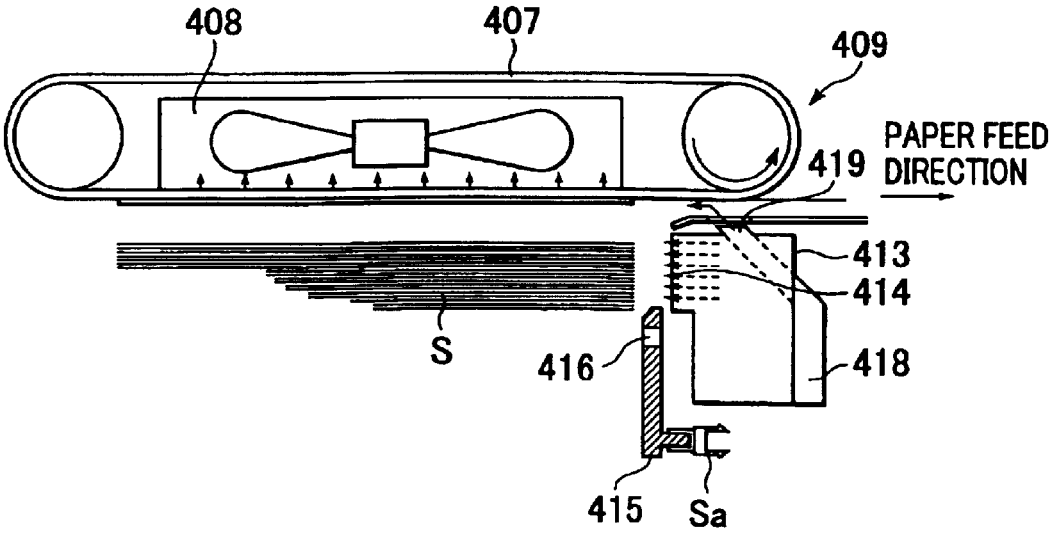

A second embodiment according to the present invention will now be described with reference to FIGS. 5A and 5B. In FIGS. 5A and 5B, the same reference numbers are used to denote the same components as those in the first embodiment, and the description thereof are omitted.

In this embodiment, a blowing duct 413 and a shutter 415 capable of moving up and down are provided on the front end side of a sheet bundle in the paper feeding direction. A separation duct 418 connected to a separation fan (not shown) has a separation nozzle 419, and it is configured so as to supply separation air in a slanting direction toward the suction belt 407 by the separation nozzle 419. This separation air operates effectively in that it causes only the sheet located in the uppermost position to adhere to the suction belt 407, and separates and lets fall the subsequent sheets.

In this embodiment, the shutter 415 reciprocates between the uppermost position (FIG. 5A) and the lowermost position (FIG. 5B). While there is provided a paper path P for conveying, toward the downstream direction, the sheet separated between the suction belt 407 along the sheet feeding direction and the blowing duct 413, the shutter 415 cannot block the paper path. Therefore, unlike the first embodiment, it is impossible to move upward the shutter 415 up to the uppermost position that will completely block the opening 414.

Accordingly, the blowing duct 413 has therein a valve 420 serving as air speed adjusting means. The valve 420 is arranged to be capable of blocking/opening the air in the blowing duct 413, that is, the valve 420 may be in an open position where it allows blowing air to be blown from the opening 414 (the state of the valve 420 in FIG. 5A), and a closed position where it blocks air to be blown (the state of the valve 420 in FIG. 5B). In this embodiment, after having sufficiently handled the sheet bundle S by blown air from the opening 414 by the reciprocating operations of the shutter 415 performed a predetermined times, it is detected, by detecting means such as a suction sensor, that the sheet located in the uppermost position is attracted to the suction belt 407 by an attracting action. Then, the blown air is blocked by closing the valve 420 (the state in FIG. 5B). Thus, the sheet feeder according to this embodiment can suction convey only the paper located in the uppermost position, in cooperation with the separation air from the separation nozzle 419, thereby allowing the subsequent sheets to be completely separated.

In this embodiment, by performing the setting of the movement speed of the shutter 415 as described in the first embodiment, a reduction in productivity is prevented. Namely, the movement period of the shutter 415 can be freely set in accordance with a material and/or environmental conditions. It is therefore possible to provide a sheet feeder that makes its productivity and separation performance mutually compatible.

Third Embodiment

Next, a third embodiment according to the present invention will be described with reference to FIGS. 6A and 6B and FIGS. 7A to 7C. In these figures, the same reference numbers are used to denote the same components as those in the above-described first and second embodiments, and the descriptions thereof are omitted.

Figure 7A:
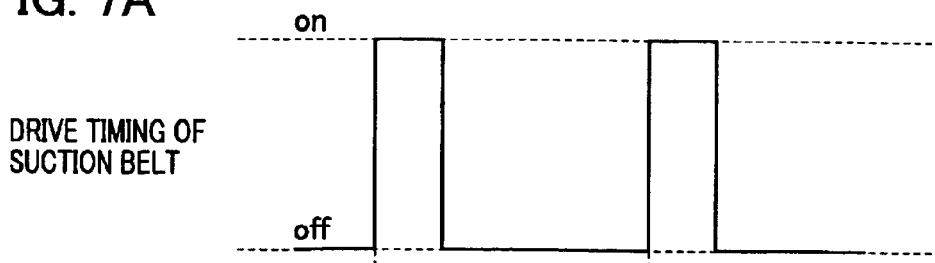
FIGS. 7A to 7C are diagrams illustrating the timing in the third embodiment.
Figure 7B:
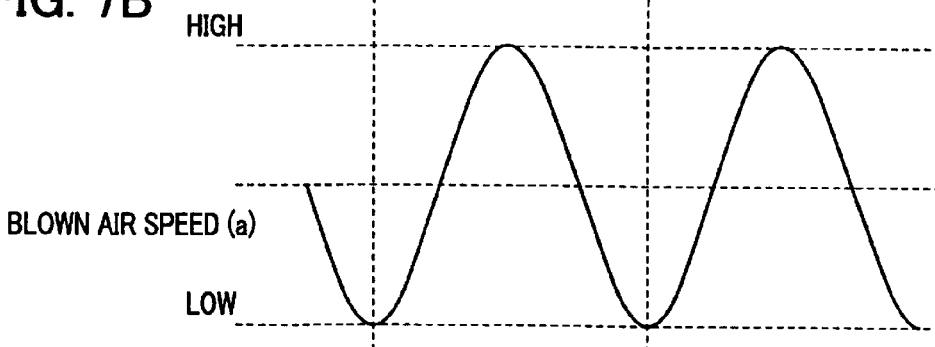
Figure 7C:
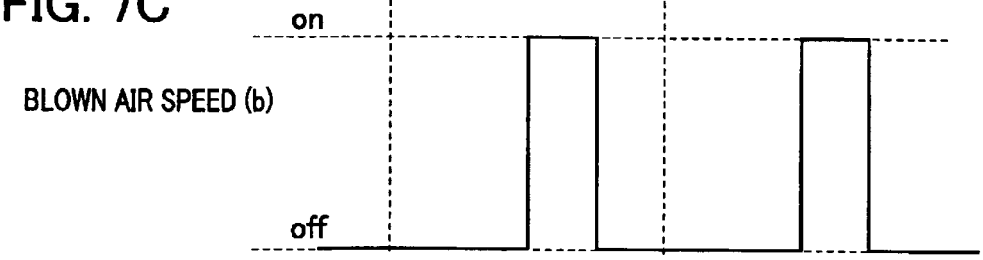

In this embodiment, as shown in FIGS. 6A and 6B and FIGS. 7A to 7C, when the suction belt 407 is driven (i.e., when it is in an on-state), the speed of blown air is set to the vicinity of the minimum speed (see FIG. 7A). The speed of blown air may be varied in accordance with any one of the location of the shutter 415, the magnitude of the blown air supply source, and the cooperation between them. According to this method, paper feed is performed at a timing when the blown air speed is sufficiently low, and therefore, it is possible to provide a sheet feeder that inhibits a double-feed such as to drag the subsequent paper, as described above.

If, using on/off switching of the blown air supply source, a setting such that the suction belt 407 is driven (i.e., it is in an on-state) when the blown air is in an off-state (see FIG. 7B) is made, paper feeding can be performed in the absence of blown air as in the case of the second embodiment, thereby securing better separation performance. When this method is applied to a sheet feeder that has relatively high productivity such as a copy rate of 80 cpm or more, a delay of air flow occurs in the on/off switching of the blown air supply source. It is, therefore, difficult to completely eliminate blown air by the paper feed timing, but because the air speed is sufficiently low, the separation performance is not hindered.

In the above described embodiment, because there is not provided the valve 420, unlike the second embodiment, an inexpensive apparatus can be provided. Furthermore, it is possible to provide a sheet feeder that makes its productivity and separation performance mutually compatible by setting the magnitude of blown air, or the period of on/off to be n times (n=1, 2, 3 . . . (integral)) the drive timing, as in the case of the second embodiment.

Fourth Embodiment

Figure 8A:
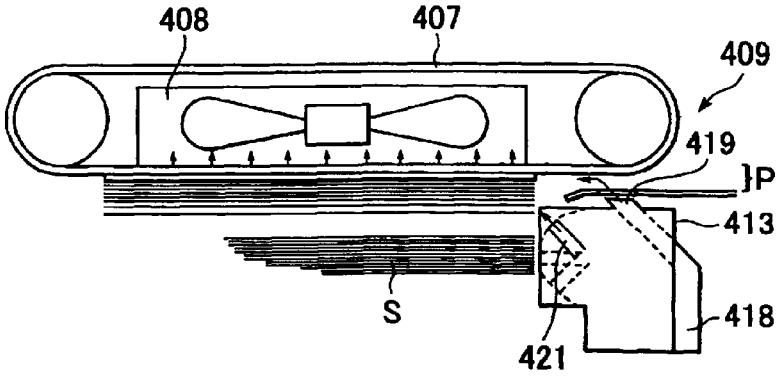
FIGS. 8A to 8C are constructional views illustrating a fourth embodiment according to the present invention.
Figure 8B:
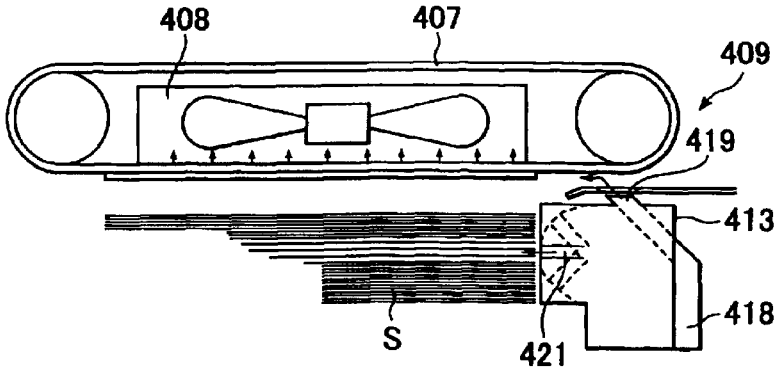
Figure 8C:
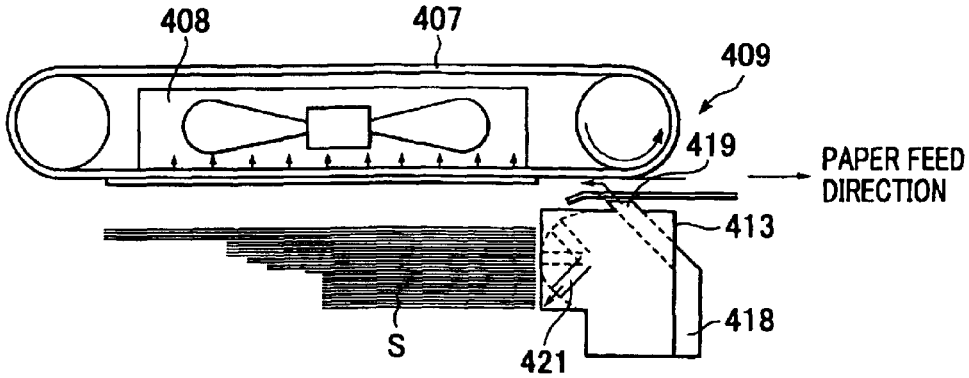

Next, a fourth embodiment according to the present invention will be described with reference to FIGS. 8A to 8C. In FIGS. 8A to 8C, the same reference numbers are used to denote the same components as those in the above-described first and second embodiments, and the description thereof are omitted.

In this embodiment, a swing nozzle 421 serving as air direction adjusting means capable of turning the side edge of upper portion of sheet bundle in the up-and-down direction, is provided in the blowing duct 413 disposed on the front end side of the sheet bundle. The swing nozzle 421 continuously blows air on the side edge of the bundle S in an upward direction (see FIG. 8A), substantially in the horizontal direction (see FIG. 8B), and in a downward direction (see FIG. 8C). The swing nozzle 421 blows air while turning in the up-and-down direction, and therefore, with respect to the sheet bundle S, the swing nozzle 421 can give air that continuously varies in air direction, thereby producing a very high effect of injecting air in the space between sheets that are adhered to each other, or sheets that are stacked in a state where upper and lower sheets are slightly deviated from each other, and separating them.

By setting the drive timing of the suction belt 407 to the time point in FIG. 8B or 8C, sheets subsequent to the sheet located in the uppermost position are prevented from being blown upward by extra air, and thereby a satisfactory paper feed separating performance can be secured.

The arrangement for turning on/off the air blowing, and/or the arrangement for setting the magnitude of air speed in the second or third embodiment, may be incorporated into the arrangement of this embodiment in order to secure optimum separating performance.

As describe above, in each of embodiments, it is possible to reliably handle the sheet bundle, and reliably perform separation by injecting air between sheets even if they are sheets adhering to each other, such as coated paper, and especially in a high moisture environment.

In the above-described embodiments, an embodiment may be used by combining with one or more other embodiments as appropriate, as a matter of course. Also, through the above-described embodiments, the position of each of the blowing duct 413 and the shutter 415 may be any position that corresponds to the end of the side-surface side of the sheet bundle S, or the end of the front end side thereof.

The structure of the separation nozzle 419 for blowing the separation air described in the second embodiment may be any known design, and the separation nozzle 419 may be used by combining it with another type of separation means such as a separation pawl, a separation pad, a reversing roller (retard roller), or the like.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet feeder, comprising:

a sheet stacking unit to support a sheet bundle;

sheet suction conveying means for generating air suction and conveying one by one a sheet of the sheet bundle supported by said sheet stacking unit, the conveyance being of an uppermost sheet of the sheet bundle;

air blowing means for blowing air against a side edge of a sheet bundle supported by said sheet stacking unit; and air speed adjusting means for varying a speed of the air blown from said air blowing means, wherein said sheet suction conveying means operates to convey a sheet from the sheet bundle when the speed of the air blown against the side edge of the sheet bundle and as varied by said air speed adjusting means is not more than a predetermined value.

2. The sheet feeder according to claim 1, wherein said air speed adjusting means periodically varies the speed of air blown by said air blowing means, and wherein the period of the air speed variation is set to an integral multiple of the period of the sheet conveying operation of said sheet suction conveying means.

3. The sheet feeder according to claim 1, wherein said air speed adjusting means comprises a shutter movable substantially vertically between said air blowing means and the side edge of the sheet bundle, wherein said shutter has an air permeable slit through which air can pass, and wherein said air speed adjusting means varies the air speed in accordance with a position of said slit.

4. The sheet feeder according to claim 1, wherein said air speed adjusting means varies the air speed by increasing or decreasing supplied air from an air supply source of said air blowing means.

5. The sheet feeder according to claim 1, further comprising air blocking means for blocking and opening a flow path of air from said air blowing means.

6. The sheet feeder according to claim 1, wherein when the speed of air blown from said air blowing means against the side edge of the sheet bundle by said air speed adjusting means is substantially zero, a sheet conveying operation of said sheet suction conveying means is performed.

7. A sheet feeder, comprising:

a sheet stacking unit to support a sheet bundle;

sheet suction conveying means for generating air suction and conveying one by one a sheet of the sheet bundle supported by said sheet stacking unit, the conveyance being of an uppermost sheet of the sheet bundle;

air blowing means for blowing air against a side edge of the sheet bundle supported by said sheet stacking unit; and air direction adjusting means for varying a direction of the air blown by said air blowing means, wherein said sheet suction conveying means operates to convey a sheet from the sheet bundle when a speed of the air blown against the side edge of the sheet bundle and in a direction varied by said air direction adjusting means is not more than a predetermined value.

8. The sheet feeder according to claim 7, wherein said air direction adjusting means periodically varies the direction of air blown by said air blowing means, and wherein the period of the air direction variation is set to an integral multiple of the period of the sheet conveying operation of said sheet suction conveying means.

9. The sheet feeder according to claim 7, wherein said air direction adjusting means has a swing nozzle moveable in an up-and-down direction.

10. A sheet feeder, comprising:

a sheet stacking unit that supports a sheet bundle;

sheet suction conveying means for generating air suction and conveying one by one a sheet of the sheet bundle supported by said sheet stacking unit, the conveyance being of an uppermost sheet of the sheet bundle;

air blowing means for blowing air against a side edge of a sheet bundle supported by said sheet stacking unit;

air speed adjusting means for varying a speed of air blown by said air blowing means; and air direction adjusting means for varying a direction of air blown by said air blowing means, wherein said sheet suction conveying means operates to convey a sheet from the sheet bundle when the speed of the air blown by cooperative action of said air speed adjusting means and said air direction adjusting means is not more than a predetermined value.

11. A sheet feeder, comprising:

an intermediate plate for holding a sheet bundle;

a suction duct located above said intermediate plate;

a suction belt provided so as to surround the suction duct located above the intermediate plate;

a blowing duct located on a side of said intermediate plate and blowing air toward the sheet bundle on said intermediate plate; and a shutter disposed between the sheet bundle on said intermediate plate and said blowing duct, said shutter having a slit, and said shutter being moveable in a substantially vertical direction between a lowermost position and an uppermost position, wherein said suction belt is rotated and delivers an uppermost sheet of said sheet bundle when said shutter has substantially reached the uppermost position.

12. An image forming apparatus, comprising:

a sheet feeder comprising:

a sheet stacking unit to support a sheet bundle;

sheet suction conveying means for generating air suction and conveying one by one a sheet of the sheet bundle supported by said sheet stacking unit, the conveyance being of an uppermost sheet of the sheet bundle;

air blowing means for blowing air on a side edge of a sheet bundle supported by said sheet stacking unit;

air speed adjusting means for varying a speed of the air blown from said air blowing means, wherein said sheet suction conveying means operates to convey a sheet from the sheet bundle when the speed of the air blown against the side edge of the sheet bundle as varied by said air speed adjusting means is not more than a predetermined value; and an image forming section for forming an image on a sheet fed out by said sheet suction conveying means.

13. An image forming apparatus according to claim 12, wherein said air speed adjusting means periodically varies the speed of air blown by said air blowing means, and wherein the period of the air speed variation is set to an integral multiple of the period of the sheet conveying operation of said sheet suction conveying means.

14. An image forming apparatus according to claim 12, wherein said air speed adjusting means comprises a shutter moveable substantially vertically between said air blowing means and the side edge of the sheet bundle, wherein said shutter has an air permeable slit through which air can pass, and wherein said air speed adjusting means varies the air speed in accordance with a position of a slit.

15. An image forming apparatus according to claim 12, wherein said air speed adjusting means varies the air speed by increasing or decreasing supplied air from an air supply source of said air blowing means.

16. An image forming apparatus according to claim 12, further comprising air blocking means for blocking and opening a flow path of air from said air blowing means.

17. An image forming apparatus according to claim 12, wherein when the speed of air blown by said air blowing means against the side edge of the sheet bundle by said air speed adjusting means is substantially zero, a sheet conveying operation of said sheet suction conveying means is performed.

18. An image forming apparatus, comprising:

a sheet feeder comprising:

a sheet stacking unit to support a sheet bundle;

sheet suction conveying means for generating air suction and conveying one by one a sheet of the sheet bundle supported by said sheet stacking unit, the conveyance being of an uppermost sheet of the sheet bundle;

air blowing means for blowing air against a side edge of the sheet bundle supported by said sheet stacking unit; and air direction adjusting means for varying a direction of the air blown by said air blowing means, wherein said sheet suction conveying means operates to convey a sheet from the sheet bundle when a speed of the air blown against the side of the sheet bundle and in a direction varied by said air direction adjusting means is not more than a predetermined value; and an image forming section for forming an image on a sheet fed out by said sheet suction conveying means.

19. An image forming apparatus according to claim 18, wherein said air direction adjusting means periodically varies the direction of air blown by said air blowing means, and wherein the period of the air direction variation is set to an integral multiple of the period of the sheet conveying operation of said sheet suction conveying means.

20. An image forming apparatus according to claim 18, wherein said air direction adjusting means has a swing nozzle moveable in an up-and-down direction.

21. An image forming apparatus comprising:

a sheet feeder comprising:

a sheet stacking unit that supports a sheet bundle;

sheet suction conveying means for generating air suction and conveying one by one a sheet of the sheet bundle supported by said sheet stacking unit, the conveyance being of an uppermost sheet of the sheet bundle;

air blowing means for blowing air against a side edge of a sheet bundle supported by said sheet stacking unit;

air speed adjusting means for varying a speed of air blown by said air blowing means;

air direction adjusting means for varying a direction of air blown by said air blowing means, wherein said sheet suction conveying means operates to convey a sheet from the sheet bundle when the speed of the air blown against the side of the sheet bundle by cooperative action of said air speed adjusting means and said air direction adjusting means is not more than a predetermined value; and an image forming section for forming an image on a sheet fed out by said sheet suction conveying means.

22. An image forming apparatus, comprising:

a sheet feeder comprising:

an intermediate plate for holding a sheet bundle;

a suction duct located above said intermediate plate;

a suction belt provided so as to surround the suction duct located above the intermediate plate;

a blowing duct located on a side of said intermediate plate and blowing air toward the sheet bundle on said intermediate plate;

a shutter disposed between the sheet bundle on said intermediate plate and said blowing duct, said shutter having a slit, and said shutter being moveable in a substantially vertical direction between a lowermost position and an uppermost position, wherein said suction belt is rotated and delivers an uppermost sheet of said sheet bundle when said shutter has substantially reached the uppermost position; and an image forming section for forming an image on a sheet delivered by said suction belt.

* * * * *

UNITED STATES PATENT AND TRADEMARK OFFICE

CERTIFICATE OF CORRECTION

PATENT NO. : 6,955,348 B2
DATED : October 18, 2005
INVENTOR(S) : Hiroto Koga

It is certified that error appears in the above-identified patent and that said Letters Patent is hereby corrected as shown below:

Title page,
Insert Item: -- [30] Foreign Application Priority Data
Sept. 20, 2002 JP 275018 --.

Column 4,
Line 9, "past" should read -- passed --.

Column 8,
Line 11, "suction convey" should read -- suction-convey --.
Line 51, "above described" should read -- above-described --.

Column 11,
Line 49, "a" (2nd occurrence) should read -- said --.

Signed and Sealed this

Second Day of May, 2006

JON W. DUDAS
*Director of the United States Patent and Trademark Office*